US006805790B2

(12) United States Patent
Gupta et al.

(10) Patent No.: US 6,805,790 B2
(45) Date of Patent: Oct. 19, 2004

(54) PROCESS AND AN APPARATUS FOR PREPARATION OF PETROLEUM HYDROCARBON SOLVENT WITH IMPROVED COLOR STABILITY FROM NITROGEN RICH CRUDE OIL

(75) Inventors: Anurag Ateet Gupta, Haryana (IN); Suresh Kumar Puri, Haryana (IN); Muniaswamy Rajesh, Haryana (IN); Ambrish Kumar Misra, Haryana (IN); Bijendra Singh Rawat, Haryana (IN); Akhilesh Kumar Bhatnagar, Haryana (IN)

(73) Assignee: India Oil Corporation Limited, Mumbai (IN)

( * ) Notice: Subject to any disclaimer, the term of this patent is extended or adjusted under 35 U.S.C. 154(b) by 0 days.

(21) Appl. No.: 10/090,446

(22) Filed: Mar. 4, 2002

(65) Prior Publication Data

US 2003/0150780 A1 Aug. 14, 2003

(30) Foreign Application Priority Data

Dec. 10, 2001 (IN) ..... 1168/MUM/2001

(51) Int. Cl.[7] ..... C10G 25/00; C07C 7/12

(52) U.S. Cl. ..... 208/299; 208/310 Z; 208/310 R; 585/820; 585/823; 585/824

(58) Field of Search ..... 208/299, 310 R, 208/310 Z; 585/820, 823, 824

(56) References Cited

U.S. PATENT DOCUMENTS 5,997,732 A * 12/1999 Yenni et al. ..... 208/307
6,579,441 B1 * 6/2003 Biscardi et al. ..... 208/18

* cited by examiner

*Primary Examiner*—Walter D. Griffin
*Assistant Examiner*—Tam M. Nguyen
(74) *Attorney, Agent, or Firm*—Ohlandt, Greeley, Ruggiero & Perle, L.L.P.

(57) ABSTRACT

A process and an apparatus for the preparation of petroleum hydrocarbon solvent with improved color stability from crude oils having high concentration of nitrogenous compounds which comprises passing said petroleum hydrocarbon stream containing substantial amount of nitrogenous compounds over a column of molecular sieves modified clays at ambient to elevated temperature and pressure maintaining the feed in the liquid state, thereby obtaining the petroleum hydrocarbon stream with desired color stability.

22 Claims, 1 Drawing Sheet

Figure 1:
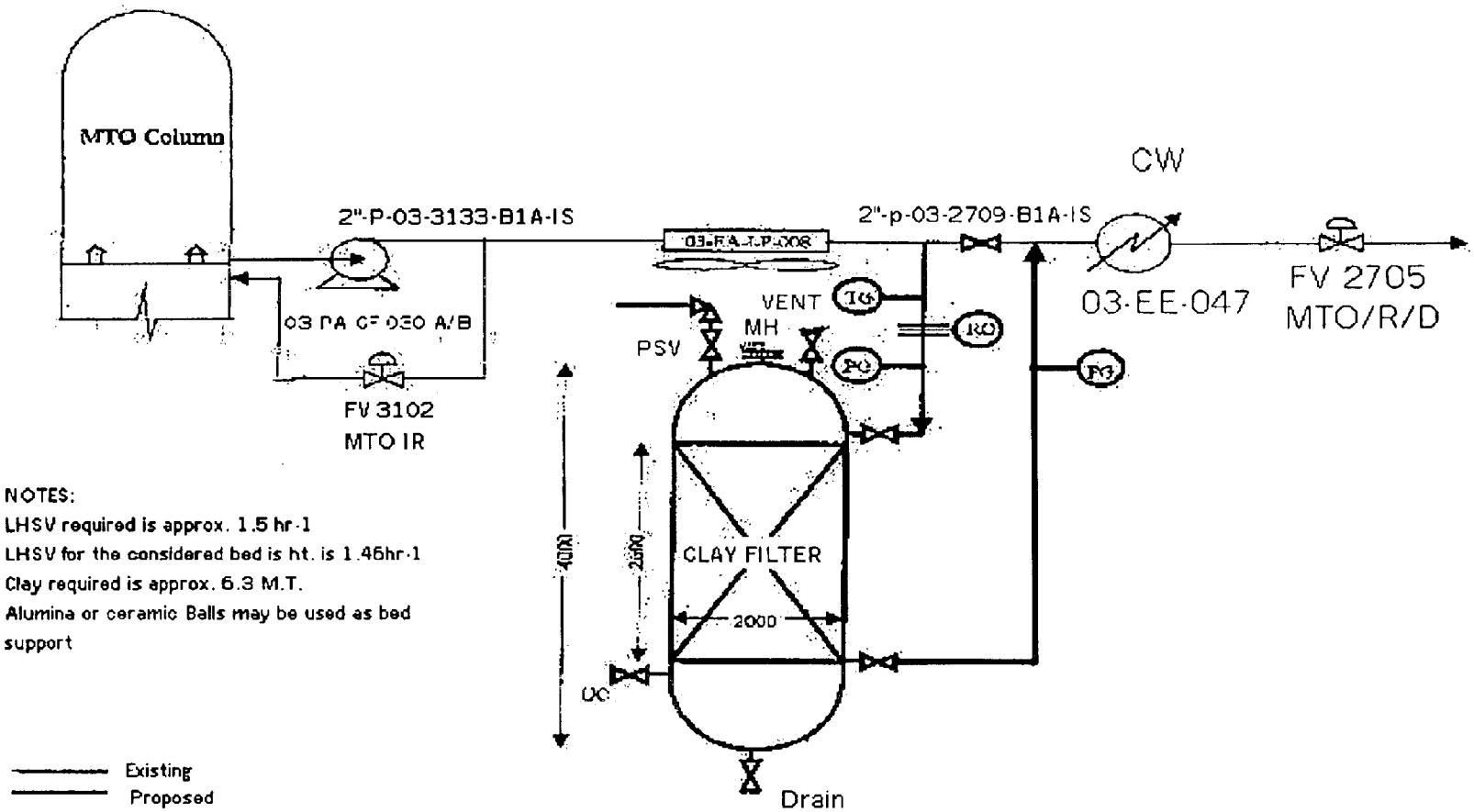

PROCESS AND AN APPARATUS FOR PREPARATION OF PETROLEUM HYDROCARBON SOLVENT WITH IMPROVED COLOR STABILITY FROM NITROGEN RICH CRUDE OIL

FIELD OF THE INVENTION

The present invention relates to a novel process and an apparatus for the production of petroleum hydrocarbon stream with desired colour stability. Particularly, the invention relates to a process and an apparatus for the production of petroleum hydrocarbon stream from crude oil having high concentration of nitrogenous compounds. More particularly, the invention relates to a process and an apparatus for the production of Mineral Turpentine Oil (MTO) of boiling range 145–205 deg. C from crude oil having high concentration of nitrogenous compounds.

BACKGROUND OF THE INVENTION

In general, petroleum hydrocarbon solvents are manufactured in oil refineries. Originally fractions are obtained by drawing off suitable streams from crude oil atmospheric distillation columns, followed by various treatments to reduce the odorous and /or corrosive impurities. For many applications, solvents obtained by straight atmospheric distillation and hence, having the hydrocarbon composition typical of that of feedstock, from which they have been made, are used as such and thus no chemical conversion or separation is required.

More particularly, Mineral Turpentine Oil (MTO) is produced in the refinery by distilling the Kerosene (Kero)/Aviation Turbine Fuel (ATF) cut obtained from crude oil distillation column followed by treatment in Merox unit for the removal of Mercaptan. The Kero I ATF cut is sent to MTO splitter column having 26 valve trays. In this splitter, Kero/ATF is fed on tray 10 of the splitter and is fractionated in three streams viz. overhead stream, side stream or MTO product and bottom streams. MTO product is withdrawn from the tray above tray 20 by MTO product pumps. The overhead and bottom streams are always routed again with Kero/ATF product stream, bypassing Merox unit. The MTO splitter operates at the top pressure of 1.1 kg/cm$^2$g. The heat required for distillation is supplied in a MTO splitter reboiler using Heavy vacuum gas oil (HVGO) circulating reflux as heating medium. The MTO product thus obtained is sent under flow control to air cooler where it is cooled and finally the cooled material is sent for storage. This product so obtained has the specifications given in Table-1.

TABLE 1

Specifications of MTO

| S. No. | Property | Bureau of Indian Specification IS-1745-1978 (grade-II) |
|---|---|---|
| 1 | Density at 15° C. g/ml | To report |
| 2 | Color (saybolt), min | +20 |
| 3 | Flash Point(Abel)° C., Min | 35 |
| 4 | Distillation | |
| | a) IBP, ° C., Min | 145 |
| | b) 50% vol rec @ ° C. | to report |
| | c) 95% vol rec @ ° C. | to report |
| | d) FBP, ° C., Min | 205 |
| 5 | Aromatic contents % V, Max | 40 |

TABLE 1-continued

Specifications of MTO

| S. No. | Property | Bureau of Indian Specification IS-1745-1978 (grade-II) |
|---|---|---|
| 6 | Copper corrosion @ 50° C. for 3 Hrs | Not worse than No 1 |
| 7 | Residue on evaporation, mg/100 ml | 5 |

In general, MTO is manufactured in refineries using crude oils containing very low nitrogen and/or sulphur contents and the product meets the IS 1745–1978 specifications. The typical data of such crude oils is given in Table-2. In order to maximize the refinery profit margins, the Applicants attempted making MTO from Nigerian low sulfur and Persian Gulf (PG) mix high sulfur crude oils which is very cheap. The typical data of such crude oils is also given in Table-2. MTO produced from these crude oils was evaluated against IS 1745–1978 specifications and the data is tabulated in Table-3.

TABLE 2

Typical properties of Low and High nitrogen crude oils

| Sr. No | CHARACTERISTICS | Low nitrogen crude oils: Bombay high | Low nitrogen crude oils: South Gujarat | High nitrogen crude oils: Nigerian | High nitrogen crude oils: PG mix |
|---|---|---|---|---|---|
| 1 | Density @ 15 deg. C gm/ml | 0.8284 | 0.8004 | 0.8465 | 0.8745 |
| 2 | Total Sulfur % wt | 0.15 | 0.07 | 0.15 | 2.8 |
| 3 | Total Nitrogen . ppm | 150 | 190 | 667 | 1300 |

TABLE 3

Analysis Data of MTO produced from Nigerian Crude

| S. No. | Property | Specification IS-1745-1978 (grade-II) | Results |
|---|---|---|---|
| 1 | Density at 15° C. g/ml | To report | 0.7890 |
| 2 | Color (saybolt), min (ASTM D156) | +20 | +10 |
| 3 | Flash Point(Abel)° C., Min | 35 | 46 |
| 4 | Distillation | | |
| | a) IBP, ° C., Min | 145 | 160.7 |
| | b) 50% vol rec @ ° C. | to report | 177.3 |
| | c) 95% vol rec @ ° C. | to report | 199.7 |
| | d) FBP, ° C., Min | 205 | 204.9 |
| 5 | Aromatic contents % V, Max | 40 | 16.1 |
| 6 | Copper corrosion @ 50° C. for 3 Hrs | Not worse than No 1 | 1 |
| 7 | Residue on evaporation, mg/100 ml | 5 | 0.6 |

It is evident from Table-3 that the MTO sample is generally meeting all the specifications except the color, which is +10 against the requirement of +20(min). Colored MTO is not acceptable to the customers using the same for dry cleaning purpose and in the paint industry. It is also reported that the colored MTO affects the catalyst and therefore above MTO cannot be used in the process involving catalysts.

The applicants therefore, took up a systematic study to ascertain the genesis of color in MTO and also to develop economically viable and operationally feasible process for the intended purpose. The MTO sample produced from Nigerian crude as well as mixture of Nigerian and PG mix crude was thoroughly analysed for other properties such as trace metal impurities, sulfur and nitrogen contents. The result of this analysis in tabulated in table 4. The Applicants found that apart from small amount of iron (Fe) no other trace metals were detected. However, total nitrogen of 5.2 ppm with basic nitrogen content of 3ppm was observed along with 0.136% of sulfur and 2.5 ppm of mercaptans. These analysis data indicate that nitrogenous compounds and mercaptans present in the MTO may be responsible for coloration of the product.

TABLE 4

Analysis Data of MTO produced from Nigerian Crude

| S. No. | Property | Results |
|---|---|---|
| 1 | Total nitrogen/Basic Nitrogen (UOP 269–70T) | 5.2 ppm/5 ppm |
| 2 | Total sulfur, % wt | 0.136 |
| 3 | Elemental analysis | Fe, <0.5 ppm<br>No element was found in significant amount |
| 4 | $H_2S$/Mercaptans | Nil/2.5 ppm |

In order to prove the above hypothesis, the crude oils (Nigerian low sulfur and Persian Gulf (PG) mix high sulfur crude oils) being processed at the refinery were subjected to distillation and various cuts were produced. It was observed that 180–205° C. cut had +13 saybolt color rating. The nitrogen contents of 180–205° C. cut was 8.5 ppm. This infers that nitrogenous compounds and mercaptans are responsible for the color instability of MTO. The detailed analysis data of these samples are summarized in Table-5.

TABLE 5

Analysis Data of Fractions Prepared at R&D Center

| S. No. | Property | Nigerian low sulfur crude 180–205 cut | PG mix high Sulfur crude 180–205 cut |
|---|---|---|---|
| 1 | Color (saybolt) | +13 | +14 |
| 2 | Copper corrosion @ 50° C. for 3 Hrs | 1 | 1 |
| 3 | Total nitrogen, ppm | 8.5 | 8.3 |
| 4 | Total sulfur, % wt | | |
| 5 | Mercaptans, ppm as Sulfur | 27 | 20 |

From the analysis data it is concluded that nitrogenous compounds in conjunction with mercaptans are imparting color instability to MTO. Therefore, removal of nitrogenous compounds would result in avoiding complex formation with mercaptans and is likely to result into improvement in color of MTO as well as the color stability on storage.

Following methods are generally employed for the removal of nitrogen impurities from hydrocarbon streams:

1. Treatment with sulfuric acid is used for partial or complete removal of unsaturated hydrocarbons, sulfur, nitrogen, and oxygen impurities, and other resinous and asphaltic compounds. It is used to improve the odor, color, stability, carbon residue, and other properties of the oil.
2. Caustic treatment using sodium (or potassium) hydroxide is used to improve odor and color by removing organic acids (naphthenic acids, phenols) and sulfur compounds (mercaptans, $H_2S$). By combining caustic soda solution with various solubility promoters (e.g., methyl alcohol and cresols), up to 99% of all mercaptans as well as oxygen and nitrogen compounds can be removed from petroleum fractions.
3. Another method used by refineries for the removal of nitrogenous impurities is by catalytic hydro-treatment. This is a hydrogenation process used to remove about 90% of contaminants such as nitrogen, sulfur, oxygen, and metals from liquid petroleum fractions. These contaminants, if not removed from the petroleum fractions can have detrimental effects on the equipment, the catalyst efficiency and effective life, and the quality of the finished products. Typically, hydro-treating is done prior to processes such as catalytic reforming so that the catalyst is not contaminated by untreated feedstock.

However, disadvantages associated with the above processes include handling of voluminous corrosive mineral acids and alkali at the refinery end and use of very costly hydrogen in the catalytic hydrotreatment process.

Further it is noted that Merox treatment of ATF/Kero results in generation of colored impurities due to highly alkaline conditions of Merox process. These impurities are generally removed by passing the product through a bed of various types of clays. This process is commonly used all over the world. However, this process and particularly, these type of clays are not effective enough to remove the basic nitrogen content to less than 1 ppm level that is required to improve the color stability of MTO. Therefore, the aim of the present invention is to propose an environment friendly, low energy and cost effective process based on adsorption technique for the removal of nitrogen or mercaptans from the petroleum hydrocarbon solvents.

OBJECTIVE OF THE INVENTION

The main object of the present invention is to provide a process and an apparatus for producing Mineral Turpentine Oil with desired color stability.

Another object of the present invention is to provide a process and an apparatus for preparing Mineral Turpentine Oil (MTO) with color stability as stipulated in Bureau of Indian Standards IS 1745-78.

Yet another object of the present invention is to provide a process and an apparatus for preparing Mineral Turpentine Oil (MTO) with boiling point in the range of 145° to 205° C. and having saybolt color rating better than +20 from crude oil feed, rich in nitrogen and/or active sulfur.

STATEMENT OF THE INVENTION

The present invention relates to a novel process and an apparatus for the production of petroleum hydrocarbon stream with desired colour stability. Particularly, the invention relates to a process and an apparatus for the production of petroleum hydrocarbon stream from crude oil having high concentration of nitrogenous compounds. More particularly, the invention relates to a process and an apparatus for the production of Mineral Turpentine Oil (MTO) of boiling range 145–205 deg. C. from crude oil having high concentration of nitrogenous compounds.

DESCRIPTION OF THE INVENTION

Accordingly, the present invention provides a process for preparing Mineral Turpentine Oil (MTO) with boiling point in the range of 145° to 205° C. and having saybolt color rating better than +20 from crude oil feed, rich in nitrogen and or active sulphur, said process comprising subjecting the petroleum hydrocarbon solvent to liquid phase adsorption in at least one column containing an adsorbent substance selected from molecular sieves, modified clays and mixtures thereof at ambient temperatures and pressure.

In an embodiment of the present invention, the crude oil feed has saybolt color rating worse than +20.

In another embodiment of the present invention, the petroleum hydrocarbon solvent feed has saybolt color rating in the range of +5 to +20.

In yet another embodiment of the present invention, the crude oil feed is selected from the group comprising of Nigerian low sulphur crude, PG mix high sulphur crude or a mixture thereof.

In still another embodiment of the present invention, the petroleum hydrocarbon solvent feed has total nitrogen content of 5.2 ppm.

In a further embodiment of the present invention, the petroleum hydrocarbon solvent feed has total sulfur content of 0.136% wt.

In one more embodiment of the present invention, the petroleum hydrocarbon solvent feed has total mercaptan content of 2.5 ppm.

In one another embodiment of the present invention, the MTO has saybolt color rating greater than +20.

In an embodiment of the present invention, the MTO has saybolt color rating in the range of +20 to +30.

In another embodiment of the present invention, the MTO has total nitrogen content equal to or less than 1 ppm.

In yet another embodiment of the present invention, the MTO has total nitrogen content less than 1 ppm.

In still another embodiment of the present invention, the MTO has zero mercaptan content.

In a further embodiment of the present invention, the adsorption is carried out at a pressure of atmospheric to 20 $kg/cm^2$.

In one more embodiment of the present invention, the adsorption is carried out at an ambient temperature to 50° C.

In one another embodiment of the present invention, the molecular sieve has a core diameter of 10A.

In an embodiment of the present invention, the molecular sieve is 13×.

In another embodiment of the present invention, the clay is modified to increase its acidity.

In yet another embodiment of the present invention, the clay is modified to increase its surface area.

In still another embodiment of the present invention, the modified clay has residual acidity in the range of 8.5 to 16 mg KOH/g.

In a further embodiment of the present invention, the modified clay has surface area in the range of 350 to 425 $m.sq.^2/g$.

In one more embodiment of the present invention, the adsorbent article is regenerated by heating it at temperatures between 200 to 300° C.

In one another embodiment of the present invention, the adsorbent article is regenerated by heating it at temperatures between 200 to 300° C. in nitrogen atmosphere.

In one further embodiment of the present invention, said process can be carried out in batch wise or continuous manner.

More particularly, the present invention provides a process for preparing Mineral Turpentine Oil (MTO) having boiling point in the range of 145° to 205° C. and having saybolt color rating better than +20 from crude oil feed rich in nitrogen and/or sulphur, said process comprising:

(i) distilling the crude oil to obtain Kerosene/Aviation Turbine fuel (ATF) cut.

(ii) subjecting the Kerosene/ATF cut to Merox treatment for removing mercaptans followed by passing it through at least one column containing fullers earth;

(iii) distilling the Merox treated Kerosene/ATF cuts to obtain MTO having boiling point in the range of 145° to 205° C. and saybolt color rating less than +20 and (iv) subjecting the MTO thus obtained to liquid phase adsorption in at least one column containing an adsorbent substance selected from molecular sieves, modified clays and mixtures thereof at ambient temperatures and pressure.

In an embodiment of the present invention, the crude oil feed is selected from the group comprising of Nigerian low sulphur crude, PG mix high sulphur crude or a mixture thereof.

The present invention also provides an apparatus for obtaining petroleum hydrocarbon solvent with improved color stability, said apparatus comprising a means for pumping the petroleum hydrocarbon solvent, a means for housing an adsorbent substance and a means for controlling the flow of the petroleum hydrocarbon solvent through the adsorbent substance.

In an embodiment of the present invention, the housing means is provided with vents.

In another embodiment of the present invention, the pumping means pump the petroleum hydrocarbon solvent from a MTO column to the housing means.

In still another embodiment of the present invention, the housing means is a cylindrical column.

In yet another embodiment of the present invention, the housing means if partly filled with the adsorbent substance.

In one more embodiment of the present invention, the adsorbent substance is selected from molecular sieves, modified clays and mixtures thereof.

In one another embodiment of the present invention, the molecular sieve has a core diameter of 10A.

In an embodiment of the present invention, the molecular sieve is 13×.

In another embodiment of the present invention, the clay is modified to increase its acidity.

In yet another embodiment of the present invention, the clay is modified to increase its surface area.

In still another embodiment of the present invention, the modified clay has residual acidity in the range of 8.5 to 16 mg KOH/g.

In one more embodiment of the present invention, the modified clay has surface area in the range of 350 to 425 m.sup.2/g.

In one another embodiment of the present invention, the means for controlling the flow of the petroleum hydrocarbon solvent through the adsorbent substance comprises of valves and pumps.

According to this invention there is provided a process for the production of MTO with color stability as stipulated in Bureau of Indian Standards IS-1745-1978 from color promoter impurities contaminated hydrocarbon solvent of the kind such as herein described which comprises subjecting the said petroleum hydrocarbon solvent to a liquid phase adsorption in at least one column containing molecular sieves/modified clays as an adsorbent.

In accordance with the present invention, there is provided a process for the production of MTO with requisite color stability which comprises passing MTO having color imparting impurities over a column of adsorbent at ambient to elevated temperature and pressure which maintains the hydrocarbon feed in the liquid state, thereby obtaining the MTO with desired color stability.

The colored MTO streams, which are employed as a feedstock, have saybolt color in the range of +05 to +20.

The process of the invention therefore consists of adsorption of color imparting impurities onto the adsorbent thereby resulting final product of desired quality as per Bureau of Indian Standards IS-1745-1978 specifications.

The adsorbents used in the invention are as follows:

i) Molecular sieves ii) Clays

It has been found that the performance of the adsorbents is most optimum in a temperature range of ambient to 50 degree centigrade and under a superficial velocity of less than 0.1 cm/sec. The operating pressure was atmosphere to 25 kg/sq.cm.

It has also been found that the adsorbent regeneration is best accomplished by treating the adsorbent with Nitrogen gas at 200 to 300° C. or simply heating the adsorbent in an oven at a temperature ranging between 200 to 300° C.

Molecular sieves used in the invention are highly specific. Molecular sieves used in the invention are selected with a 10 A pore size. It should be noted molecular sieves having any other pore diameter are effective in removing the nitrogen and sulphur content to the desired level. The characteristic of the molecular sieve is given in Table-6.

Clays used in the invention are chemically modified clays. The commercial montimorilite type clays are pulverized, sieved and soaked in water to prepare slurry. This slurry is then subjected to sulfuric acid treatment followed by washing with water to maintain the acidity in the range of 3–4 pH. it is noted that if the acidity is increased to very levels, the life of the clay gets deteriorated. This clay was then filtered and dried at a temperature of 250° C. The characteristics of the two clays thus obtained are given in Table 7. These adsorbents can be used either singularly or in combination in varied proportions. Regeneration of any of these adsorbents is accomplished using nitrogen flow at elevated temperatures or heating the adsorbent as such at temperatures ranging from 200–300° C.

TABLE 6

Characteristics of Molecular Sieves

| S. NO | CHARACTERISTICS | TYPICAL PROPERTIES |
|---|---|---|
| 1 | Pore Dia, .ANG | 10 |
| 2 | Alkali Metal | Sodium |
| 3 | Bulk Density, g/l | 530 min |
| 4 | Bed Crushing Strength Value, % | 75 min |
| 5 | Loss on Attrition, % | 0.2–0.5 |
| 6 | Crush Strength | 3.5–6.0 kg |

TABLE 7

Characteristics of Clay

| S.No. | CHARACTERISTICS | Typical Data Clay-1 | Clay-2 |
|---|---|---|---|
| 1 | Moisture (% wt. Loss at 105.degree.C.) | 12 | 12 |
| 2 | Residual Acidity, mg KOH/g | 8.5 | 16 |
| 3 | Particle Size, Type Standard Sieve | | |
| | i) Passing 20 mesh, wt % | 70 | 85 |
| | ii) Passing 60 mesh, wt % | 5 | 5 |
| 4 | Bulk Density, g/l | 740 | 750 |
| 5 | Surface Area, (BET), m.sq.$^2$/g | 425 | 350 |
| 6 | Effective Particle Size(Cal.) mm | 0.48 | 0.48 |
| 7 | Void Fraction (Packed) | 0.32 | 0.32 |
| 8 | Total Pore Volume, cc/g (Mercury Porosimeter) | 0.198 | 0.176 |

The useful life of adsorbents under the conditions of experiments carried out is found to be quite high as adsorbent regeneration with nitrogen gas at 200–300° C. or simply heating at 200–300° C. provides adsorbent with similar efficiency as that of fresh adsorbents.

The invention is described as follows:

The MTO having +10 saybolt color is passed through the adsorbent bed. The feed comes in contact with adsorbent where care is taken to avoid channeling. The color imparting impurities present in the feed get adsorbed on the active sites of adsorbent thereby improving the color stability to the desired level.

The treated hydrocarbon stream is withdrawn and pumped to the storage facilities. On saturation of the adsorbent bed, heated nitrogen gas (200–300° C.) is passed through the adsorbent bed while the feed flow is diverted to the other column containing similar type and of quantity of adsorbent.

BRIEF DESCRIPTION OF THE ACCOMPANYING DRAWING

In the drawing accompanying the specification, FIG. 1 represents the plant for treating obtaining petroleum hydrocarbon solvent with improved color stability.

The invention will now be described in detail with the help of following examples which are given by way illustration and therefore, should not be construed to limit the scope of the invention in any manner.

EXAMPLE-1

A 200 ml sample of colored MTO having saybolt color of +10 was contacted with 10 g of activated molecular sieves for 60 minutes in batch mode at an ambient temperature and pressure at a fixed RPM of 60 using a reactor of one liter capacity. Treated MTO obtained from the column was found to have desired improvement in color. The details are given as follows:

| S. No. | Saybolt Color Rating | Basic Nitrogen contents (ppm) | $H_2S$/Mercaptans Ppm |
|---|---|---|---|
| 1 | +25 | <1 | Nil |

The sample after molecular sieves /clays treatment has been kept at 43° C. for color stability and after 7 days no change in the color was observed.

EXAMPLE-2

A sample of colored MTO fraction having saybolt color of +10 was passed through a column packed with molecular sieves, which is maintained at ambient temperature and pressure condition. The quantity of molecular sieves packed in the column was 100 grams. The flow rate of the feed was 180 ml per hour. The effluent was analysed and found to have improved color. The details are as follows:

| S. No. | Saybolt Color Rating | Basic Nitrogen contents (ppm) | $H_2S$/Mercaptans Ppm |
|---|---|---|---|
| 1 | +25 | <1 | Nil |

EXAMPLE-3

Same experiment was performed as described in example-2 but changing the absorbent to clay-1. The effluent has desired color stability. The details of analysis are given as follows:

| S. No. | Saybolt Color Rating | Basic Nitrogen contents (ppm) | $H_2S$/Mercaptans Ppm |
|---|---|---|---|
| 1 | +25 | <1 | Nil |

EXAMPLE-4

Same experiment was performed as described in example-2 but changing the absorbent to clay-2. The results are given as follows:

| S. No. | Saybolt Color Rating | Basic Nitrogen contents (ppm) | $H_2S$/Mercaptans Ppm |
|---|---|---|---|
| 1 | +25 | <1 | Nil |

EXAMPLE-5

A sample of colored MTO fraction having saybolt color of +10 was passed through a packed column containing 100 gms of molecular sieves maintained at 50 degree centigrade at a pressure of 20 kg/sq. cm. The feed flow was controlled at 180 ml per hour. The effluent has better than +20 saybolt color and nitrogen contents were also less than 1 ppm.

EXAMPLE-6

Same experiment was performed as described in example-5 but changing the adsorbent to clay-1. The analysis of rundown MTO is as follows:

| S. No. | Saybolt Color Rating | Basic Nitrogen contents (ppm) | $H_2S$/Mercaptans Ppm |
|---|---|---|---|
| 1 | +25 | <1 | Nil |

EXAMPLE-7

Same experiment was performed as described in example-5 but changing the adsorbent to clay-2. The effluent was found to have the following properties:

| S. No. | Saybolt Color Rating | Basic Nitrogen contents (ppm) | $H_2S$/Mercaptans Ppm |
|---|---|---|---|
| 1 | +25 | <1 | Nil |

EXAMPLE-8

The experiment was set up as in example-2. The feed flow was varied form 150 to 300 ml/hour to observe the effect of superficial velocity on the saybolt color and nitrogen content. From the analysis of the effluent product of the reactor, the superficial velocity of 0.01 cm/sec to 0.1 cm/sec. was found suitable for the use of all type of adsorbents.

EXAMPLE-9

The experiment was set up as in example 2. The feed flow was continued for 100 hours. The saybolt color and nitrogen content of the resultant effluent was found to increase with time uniformly and could be brought down suitably by adjusting the flow rate of the MTO sample.

EXAMPLE-10

The experiment was set up as in example-2. The MTO sample from MTO splitter unit was taken and fed into the molecular sieves bed maintained at an initial ambient temperature and pressure. The feeding was continued till the effluent saybolt color reached the desired limit of +20 min. The bed temperature was raised by 5 degrees centigrade and the feeding continued holding the effluent saybolt color limit of +20 min. This procedure continued till the bed temperature reached 50 degrees centigrade. The composite effluent thus collected had the following results of saybolt color and nitrogen contents:

| S. No. | Saybolt Color Rating | Basic Nitrogen contents (ppm) | $H_2S$/Mercaptans Ppm |
|---|---|---|---|
| 1 | +25 | <1 | Nil |

EXAMPLE-11

Same experiment was performed as described in example-10 but changing the molecular sieves to clay-1. The effluent was analysed for color and nitrogen contents and the results are as follows:

| S. No. | Saybolt Color Rating | Basic Nitrogen contents (ppm) | $H_2S$/Mercaptans Ppm |
|---|---|---|---|
| 1 | +25 | <1 | Nil |

EXAMPLE-12

Same experiment was performed as described in example-10 but changing the molecular sieves to clay-2. The effluent showed the following results:

| S. No. | Saybolt Color Rating | Basic Nitrogen contents (ppm) | $H_2S$/Mercaptans Ppm |
|---|---|---|---|
| 1 | +25 | <1 | Nil |

What is claimed is:

1. A process for preparing Mineral Turpentine Oil (MTO) having boiling point in the range of 145° to 205° C. and having saybolt color rating better than +20 from crude oil feed rich in nitrogen and/or active sulphur, said process comprising:

distilling the crude oil to obtain Kerosene/Aviation Turbine fuel (ATF) cut;

subjecting the Kerosene/ATF cut to Merox treatment for removing mercaptans followed by passing it through at least one column containing fullers earth;

distilling the Merox treated Kerosene/ATF cuts to obtain MTO having boiling point in the range of 145° to 205° C. and saybolt color rating less than +20; and subjecting the MTO thus obtained to liquid phase adsorption in at least one column containing an adsorbent substance selected from molecular sieves, modified clays and mixtures thereof at ambient temperatures and pressure.

2. A process as claimed in claim 1, wherein the crude oil feed is selected from the group comprising of Nigerian low sulphur crude, PG mix high sulphur crude or a mixture thereof.

3. A process as claimed in claim 1, wherein the crude oil has saybolt color rating in the range of +5 to +20.

4. A process as claimed in claim 1, wherein the crude oil has total nitrogen content of 5.2 ppm.

5. A process as claimed in claim 1, wherein the crude oil has total sulfur content of 0.136% wt.

6. A process as claimed in claim 1, wherein the crude oil has total mercaptan content of 2.5 ppm.

7. A process as claimed in claim 1, wherein the crude oil has boiling point in the range of 180 to 205° C.

8. A process as claimed in claim 1, wherein the MTO has saybolt color rating in the range of +20 to +30.

9. A process as claimed in claim 1, wherein the MTO has total nitrogen content equal to or less than 1 ppm.

10. A process as claimed in claim 1, wherein the MTO has total nitrogen content less than 1 ppm.

11. A process as claimed in claim 1, wherein the MTO has zero mercaptan content.

12. A process as claimed in claim 1, wherein the adsorption is carried out at a pressure of atmospheric to 20 $kg/cm^2$.

13. A process as claimed in claim 1, wherein the adsorption is carried out at an ambient temperature to 50° C.

14. A process as claimed in claim 1, wherein the molecular sieve has a core diameter of 10 Angstroms.

15. A process as claimed in claim 1, wherein the molecular sieve is 13×.

16. A process as claimed in claim 1, wherein the clay is modified to increase its acidity.

17. A process as claimed in claim 1, wherein the clay is modified to increase its surface area.

18. A process as claimed in claim 1, wherein the modified clay has residual acidity in the range of 8.5 to 16 mg KOH/g.

19. A process as claimed in claim 1, wherein the modified clay has surface area in the range of 350 to 425 $m.sq.^2/g$.

20. A process as claimed in claim 1, wherein the adsorbent substance is regenerated by heating it at temperatures between 200 to 300° C.

21. A process as claimed in claim 1, wherein the adsorbent substance is regenerated by heating it at temperatures between 200 to 300° C. in nitrogen atmosphere.

22. A process as claimed in claim 1, wherein said process can be carried out in batch wise or in continuous manner.

* * * * *